US010044113B2

(12) United States Patent
Tardieu

(10) Patent No.: US 10,044,113 B2
(45) Date of Patent: Aug. 7, 2018

(54) TWO-WAY CRIMPLESS BUTT CONNECTOR

(71) Applicant: Joshua Tardieu, Plantation, FL (US)

(72) Inventor: Joshua Tardieu, Plantation, FL (US)

( * ) Notice: Subject to any disclaimer, the term of this patent is extended or adjusted under 35 U.S.C. 154(b) by 0 days.

(21) Appl. No.: 15/620,906

(22) Filed: Jun. 13, 2017

(65) Prior Publication Data

US 2017/0358871 A1 Dec. 14, 2017

Related U.S. Application Data

(60) Provisional application No. 62/349,204, filed on Jun. 13, 2016.

(51) Int. Cl.

| | |
|---|---|
| ***H01R 13/28*** | (2006.01) |
| ***H01R 4/16*** | (2006.01) |
| ***H01R 4/2404*** | (2018.01) |
| ***H01R 4/64*** | (2006.01) |
| ***H01R 4/70*** | (2006.01) |

(52) U.S. Cl.
CPC ..... *H01R 4/16* (2013.01); *H01R 4/2404* (2013.01); *H01R 4/646* (2013.01); *H01R 4/70* (2013.01)

(58) Field of Classification Search
CPC ..... H01R 4/16; H01R 4/2404; H01R 4/646; H01R 4/70
USPC ..... 439/289
See application file for complete search history.

(56) References Cited

U.S. PATENT DOCUMENTS

| | | | | |
|---|---|---|---|---|
| 2,832,816 | A | 4/1958 | Curtiss | |
| 3,143,595 | A * | 8/1964 | Martin | H01R 4/72 174/84 C |
| 3,771,112 | A | 11/1973 | Thompson et al. | |
| 4,772,235 | A | 9/1988 | Lustig | |
| 6,071,145 | A | 6/2000 | Toly | |
| 7,226,308 | B1 | 6/2007 | Hanks | |
| 7,256,348 | B1 * | 8/2007 | Endacott | H01R 4/183 174/84 C |
| 8,350,155 | B2 * | 1/2013 | Kobayashi | H01R 4/186 174/84 R |
| 2010/0147585 | A1 | 6/2010 | Kobayashi et al. | |

* cited by examiner

*Primary Examiner* — Xuong Chung Trans
(74) *Attorney, Agent, or Firm* — Global Intellectual Property Agency, LLC; Jordan Sworen

(57) ABSTRACT

A two-way crimpless butt connector is provided. The butt connector includes a cylindrical housing including a pair of open ends providing two-way entry into the housing, a cylindrical conduit including a pair of open ends each configured to receive an end of a wire therein, and a fastener configured to secure and adjoin the pair of wire ends in the conduit. The fastener includes bendable teeth disposed on the open ends of the conduit. The teeth protrude radially inwardly and form an opening including a diameter smaller than a diameter of the wire ends. When a wire end is inserted into the conduit, the teeth bend with the wire end, thereby engaging the wire end and securing it within the conduit. In this way, the wire ends may be inserted into the housing, adjoined, and locked in the conduit without the use of a crimper, thereby establishing an electrical connection therebetween.

19 Claims, 3 Drawing Sheets

TWO-WAY CRIMPLESS BUTT CONNECTOR

CROSS REFERENCE TO RELATED APPLICATIONS

This application claims the benefit of U.S. Provisional Application No. 62/349,204 filed on Jun. 13, 2016. The above identified patent application is herein incorporated by reference in its entirety to provide continuity of disclosure.

BACKGROUND OF THE INVENTION

The present invention relates to electrical connectors. More specifically, the present invention relates to a two-way butt connector including an interior conductive housing and a fastener configured to adjoin and secure two ends of a wire within the housing without the need of a crimper.

A crimping tool is a device used to conjoin two pieces of metal, such as two electrical wires, by deforming one or both of them in a way that causes them to hold each other. The bend or deformity resulting from the tool's work is called a crimp, which ensures that the two pieces of metal have been conjoined. In electrical wiring, crimping tools, or crimpers, are employed in order to repair or join damaged or broken wires. The crimper is commonly employed with a butt connector to terminate the wires safely. Butt connectors include an external insulating area and a bore including a conductive housing, or conduit that receives two ends, or butts, of a wire into either side. Upon insertion of the wire ends into the conduit, the butt connector is crimped around the two wire ends, thereby securing the wire ends to one another and establishing an electrical connection therebetween.

Though current butt connectors enable joinder of two wire ends, they require crimpers in order to secure the wire ends within the conduit in which they have been inserted. Current butt connectors are unable secure two wire ends together without the use of a crimper. For example, if an electrician forgets his or her crimper, the wire ends cannot be connected and the electrician cannot ensure proper repair of the broken or damaged wire. Moreover, installing different types of wires requiring connections would not be feasible. Ultimately, lacking a means by which to secure two wire ends together without a crimper may lead to the exposure of stripped wires for prolonged periods of time, causing additional wire damage or hazardous conditions. Therefore, there is a need in the art for a butt connector configured to secure two wire ends together without the use of a crimper.

SUMMARY OF THE INVENTION

In view of the foregoing disadvantages inherent in the known types of butt connectors now present in the prior art, the present invention provides a two-way crimpless butt connector wherein the same can be utilized for providing convenience for the user when repairing or joining broken or damaged wires.

In one embodiment of the present invention, the two-way crimpless butt connector includes a cylindrical housing including a first end, a second end, and a middle portion. A longitudinal bore extends longitudinally through the housing from the first end to the second end. The first and second ends each include an opening for providing access to the longitudinal bore. A cylindrical conduit including a first and second end is disposed longitudinally in the longitudinal bore. A plurality of teeth disposed annularly, at fixed intervals, about a perimeter edge of the first and second ends of the conduit extend radially inwardly. Each of the plurality of teeth define an opening at the first and second end that includes a diameter less than a diameter of a wire end. The plurality of teeth are configured to bend inwardly upon insertion of a wire end into the conduit, such that they can grasp the wire end inserted therein.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
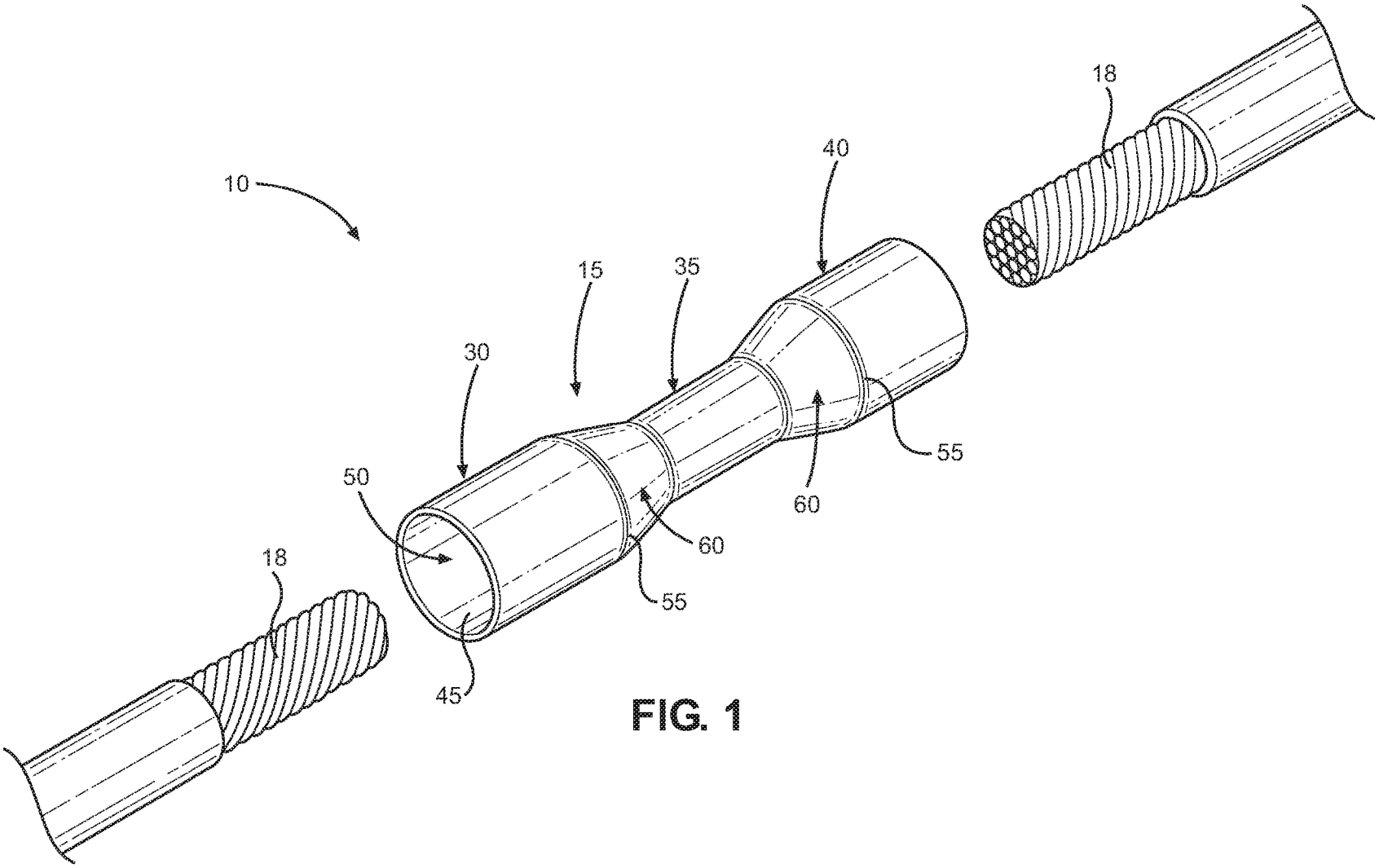
FIG. 1 shows a perspective view of the two-way crimpless butt connector.

Reference is made herein to the attached drawings. Like reference numerals are used throughout the drawings to depict like or similar elements of the two-way crimpless butt connector. The figures are intended for representative purposes only and should not be considered to be limiting in any respect.

Figure 2:
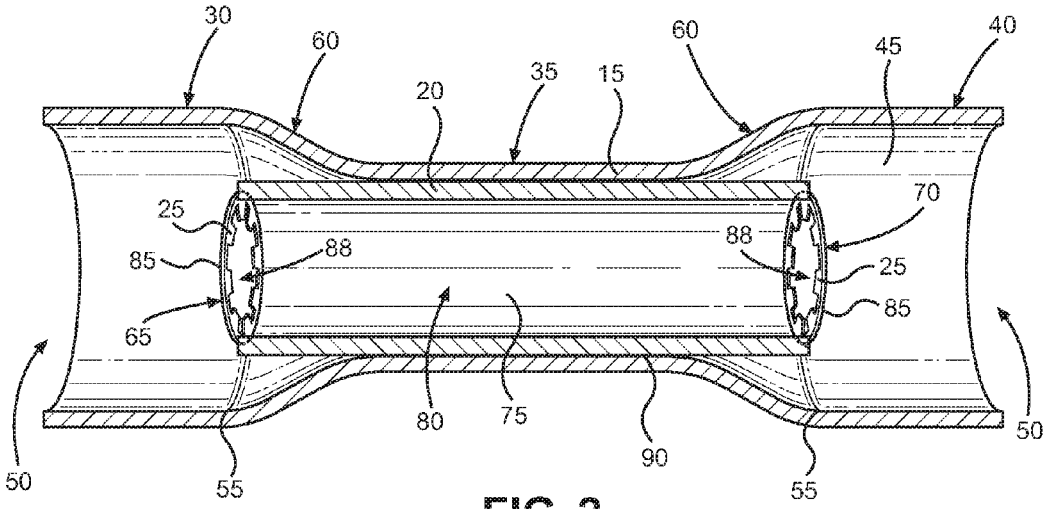
FIG. 2 shows a cross-sectional view of the two-way crimpless butt connector along a longitudinal axis.
Figure 3:
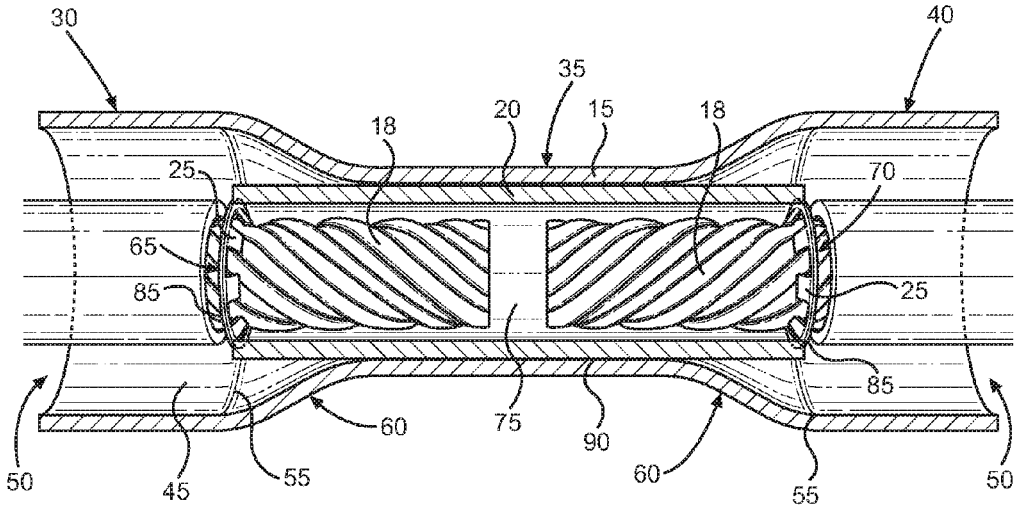
FIG. 3 shows a cross-sectional view of the two-way crimpless butt connector along a longitudinal axis illustrating wire ends adjoined within the conduit.

Referring now to FIGS. 1-3, there is shown a perspective view of the two-way crimpless butt connector and cross-sectional views of the two-way crimpless butt connector, along a longitudinal axis, with and without wire ends inserted therein. The present invention includes a crimpless butt connector 10 including a cylindrical housing 15 providing two-way entry therein, a cylindrical conduit 20 configured to receive a pair of wire ends 18 therein, and a fastener 25 configured to secure and adjoin the pair of wire ends 18 in the conduit 20, in order to establish an electrical connection therebetween without the use of a crimper.

The cylindrical housing 15 includes a first end 30, a middle portion 35, a second end 40, and a longitudinal bore 45 extending longitudinally through the housing 15 from the first end 30 to second end 40. The first and second ends 30, 40 each include an opening 50 that provides access to the longitudinal bore 45 from either end 30, 40 of the housing 15, hence, two-way entry into the housing 15. In one embodiment, the first and second ends 30, 40 flare radially outwardly and include a diameter larger than the diameter of the middle portion 35, thereby giving the longitudinal bore 45 a larger cross-sectional area at the first and second ends 30, 40 than at the middle portion 35 of the housing 15. In an alternative embodiment, the first end 30 includes a diameter equal to a diameter of the second end 40.

Figure 4:
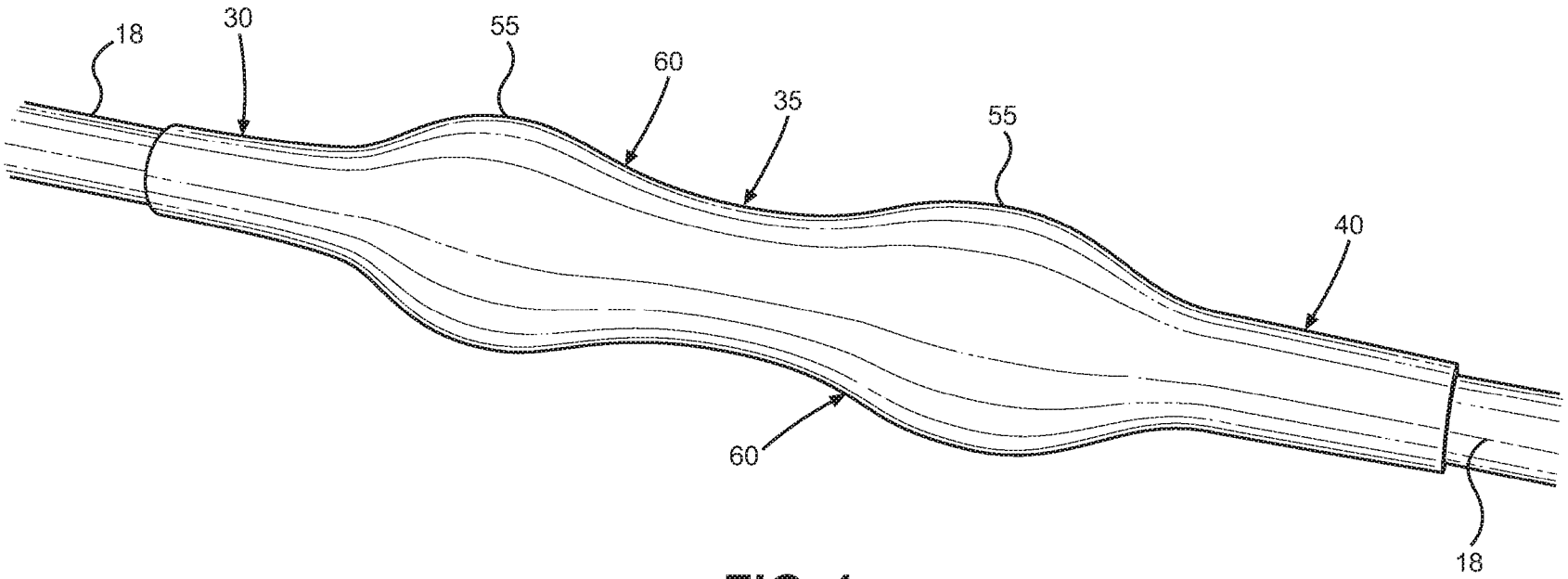
FIG. 4 shows a perspective view of the two-way crimpless butt connector illustrating the housing secured around the adjoined wire ends.

In one embodiment, the first and second ends 30, 40, include a flex point 55, or a point along the housing 15 about which the first and second ends 30, 40 are configured to bend, thereby enabling the first and second ends 30, 40 to bend around the pair of wire ends 18 after being inserted into the housing 15, as illustrated by FIG. 4. At the flex point 55, the first and second ends 30, 40 taper radially inwardly towards the middle portion 35, thereby forming a sloping region 60, which gives the housing 15 an hourglass shape. The housing 15 comprises a pliable insulation material, or a pliable insulator, such as nylon, polyimide, polyvinyl chloride (PVC), neoprene, and polyethylene. In another embodiment, the housing 15 comprises a heatshrink material, or thermoplastic material, such as polyolefin, polyvinylidene fluoride, polytetrafluoroethylene, fluorinated ethylene propylene, PVC, neoprene, silicone elastomer, and Viton®.

The cylindrical conduit 20 is disposed within the housing 15 and extends longitudinally through the longitudinal bore 45. The conduit 20 comprises a conductive material such as copper, aluminum, zinc, nickel, and brass, for conducting electricity and establishing a connecting between a pair of wire ends 18 inserted therein. The conduit 20 includes a first end 65, a second end 70, and a channel 75 defining an interior volume 80. The channel 75 extends longitudinally through the conduit 20 from the first end 65 to the second end 70. The first and second ends 65, 70 provides access to the channel 75 from either end 65, 70 of the conduit 20, i.e., two-way entry into the conduit 20.

The conduit 20 is disposed centrally within the housing 15, such that it is centered along the length of the longitudinal bore 45. The conduit 20 includes a length that is less than the length of the housing 15, such that the conduit 20 does not extend past the first and second ends 30, 40 of the housing 15, but greater than a length of a wire end, such that the conduit 20 can receive the entire length of the wire end therein. In one embodiment, the conduit 20 includes a length greater than or equal to twice the length of a wire end or a wire, such that it can receive a pair of wire ends therein. In one embodiment, the conduit 20 is affixed to an interior wall 90 of the housing 15, via an adhesive, such that the conduit 20 is secured therein. In another embodiment, the conduit 20 is mounted into the housing 15 via a friction-fit with the interior wall 90. In one embodiment, the conduit 20 includes a diameter smaller than the diameter of the housing 15, such as a diameter equal to the diameter of the longitudinal bore 45, such that the conduit 20 may be mounted therein. In another embodiment, the conduit 20 and housing 15 include equal diameters, such that the conduit 20 may be mounted or embedded within the surface of the housing 15.

The fastener 25 is disposed annularly about a perimeter edge 85 of the first and second ends 65, 70 of the conduit 20. The fastener 25 protrudes radially inwardly relative to the conduit 20. The fastener 25 comprises a pliable conductive material configured to bend and conduct electricity, such as copper, aluminum, and brass. In the depicted embodiment, the fastener 25 includes a plurality of teeth disposed annularly, at fixed intervals, about the perimeter edges 85. The plurality of teeth extend inwardly, forming an opening 88 including a diameter smaller than a diameter of a wire end 18, as illustrated by FIG. 2. In this way, the plurality of teeth are configured to make contact with the wire ends 18 when inserted into the conduit 20, as illustrated by FIG. 3, in order to establish an electrical connection therebetween.

The plurality of teeth are further configured to bend inwardly about the perimeter edges 85 towards a center of the conduit 20, such that when the wire ends 18 are inserted into the conduit 20, the plurality of teeth bend inwardly grasping the wire ends 18 annularly therearound and holding them securely in the conduit 20, as illustrated by FIG. 3. In this way, the plurality of teeth adjoin the wire ends 18 in the conduit without a crimper and prevent the wire ends 18 from inadvertent egress out the conduit 20 when in use. In one embodiment, the plurality of teeth are hingedly connected, such as by a living hinge, to the perimeter edges 85, thereby enabling them to fold inwardly. In another embodiment, the plurality of teeth are biased outwardly towards their respective ends 65, 70, such that they further grasp the wire ends 18 and hold them within the conduit 20.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A butt connector, comprising:

a cylindrical housing including a first end, a second end, a middle portion, and a longitudinal bore extending longitudinally through the housing from the first end to the second end, the first end and the second end each including an opening for providing access to the longitudinal bore;

a cylindrical conduit disposed longitudinally in the longitudinal bore, the cylindrical conduit including a first end and a second end;

a fastener disposed annularly about a perimeter edge of the first end and the second end of the cylindrical conduit, the fastener extending radially inwardly and comprising an opening including a diameter smaller than a diameter of a wire end, the fastener configured to bend inwardly upon insertion of a wire end into the cylindrical conduit.

2. The butt connector of claim 1, wherein the first end and the second end of the cylindrical housing flare radially outwardly, each of the first end and the second end including a diameter larger than a diameter of the middle portion of cylindrical housing.

3. The butt connector of claim 2, wherein the diameter of the first end is equal to the diameter of the second end.

4. The butt connector of claim 2, wherein the longitudinal bore includes a larger diameter at the first end and at the second end of the cylindrical housing than at the middle portion of the housing.

5. The butt connector of claim 1, wherein the first end and the second end of the cylindrical housing each include a flex point configured to bend.

6. The butt connector of claim 5, wherein the flex point includes a sloping region tapering radially inwardly towards the middle portion of the cylindrical housing.

7. The butt connector of claim 1, wherein the cylindrical housing comprises a pliable insulator selected from the group consisting of nylon, polyimide, polyvinyl chloride, neoprene, and polyethylene.

8. The butt connector of claim 1, wherein the cylindrical conduit includes a channel defining an interior volume configured to receive a pair of wire ends therein.

9. The butt connector of claim 1, wherein the cylindrical conduit includes a length smaller than a length of the cylindrical housing and greater than a length of a wire end.

10. The butt connector of claim 9, wherein the length of the cylindrical conduit is smaller than a length of the cylindrical housing and greater than or equal to twice the length of a wire end.

11. The butt connector of claim 1, wherein the cylindrical conduit is affixed to a center of the longitudinal bore of the cylindrical housing, such that it is centered therein.

12. The butt connector of claim 1, wherein the cylindrical conduit is fixedly attached to an interior wall of the housing via an adhesive.

13. The butt connector of claim 1, wherein the cylindrical conduit is affixed to an interior wall of the housing via a friction fit.

14. The butt connector of claim 1, wherein the cylindrical conduit includes a diameter less than or equal to a diameter of the longitudinal bore.

15. The butt connector of claim 1, wherein the diameter of the cylindrical conduit comprises a conductive material selected from the group consisting of copper, aluminum, zinc, nickel, and brass.

16. The butt connector of claim 1, wherein the fastener includes a plurality of teeth extending annularly at fixed intervals about the perimeter edge of the each of the first and second ends of the cylindrical conduit, the plurality of teeth configured to make contact with a wire end inserted into the cylindrical conduit and establish an electrical connection therewith.

17. The butt connector of claim 16, wherein the plurality of teeth are hingedly connected to the perimeter edge of the each of the first and second ends of the cylindrical conduit via a living hinge.

18. The butt connector of claim 16, wherein the plurality of teeth comprises a pliable conductive material selected from the group consisting of copper, aluminum, and brass.

19. The butt connector of claim 16, wherein the plurality of teeth are biased outwardly towards their respective first and second ends of the cylindrical conduit.

* * * * *